US008558442B2

(12) United States Patent
Kameda

(10) Patent No.: US 8,558,442 B2
(45) Date of Patent: Oct. 15, 2013

(54) PLASMA JET IGNITION PLUG

(75) Inventor: Hiroyuki Kameda, Aichi-ken (JP)

(73) Assignee: NGK Spark Plug Co., Ltd., Aichi (JP)

( * ) Notice: Subject to any disclaimer, the term of this patent is extended or adjusted under 35 U.S.C. 154(b) by 54 days.

(21) Appl. No.: 13/308,802

(22) Filed: Dec. 1, 2011

(65) Prior Publication Data

US 2012/0153799 A1 Jun. 21, 2012

(30) Foreign Application Priority Data

Dec. 15, 2010 (JP) ..... 2010-278800

(51) Int. Cl.
*H01T 13/20* (2006.01)

(52) U.S. Cl.
USPC ..... 313/141; 313/118; 313/132; 313/135; 313/138; 313/139; 313/142; 313/144

(58) Field of Classification Search
USPC ..... 313/118, 132, 135, 138, 139, 141, 142, 313/144
See application file for complete search history.

(56) References Cited

U.S. PATENT DOCUMENTS 3,133,223 A * 5/1964 Mallory ..... 313/130
3,581,141 A * 5/1971 Beaubier ..... 313/130
3,831,562 A * 8/1974 Paxton et al. ..... 123/210
4,388,549 A * 6/1983 Bensman ..... 313/138
4,396,855 A * 8/1983 Imai et al. ..... 313/139
4,487,192 A * 12/1984 Anderson et al. ..... 123/654
4,795,937 A * 1/1989 Wagner et al. ..... 313/130
4,963,784 A * 10/1990 Niessner ..... 313/131 R
7,772,752 B2 * 8/2010 Nakamura et al. ..... 313/141
2005/0227567 A1 * 10/2005 Geier et al. ..... 445/7
2008/0121200 A1 * 5/2008 Kato et al. ..... 123/143 B

FOREIGN PATENT DOCUMENTS

JP 2006-294257 10/2006

* cited by examiner

*Primary Examiner* — Nimeshkumar Patel
*Assistant Examiner* — Thomas A Hollweg
(74) *Attorney, Agent, or Firm* — Kusner & Jaffe

(57) ABSTRACT

A plasma jet ignition plug exhibiting high plasma generation efficiency while restraining occurrence of preignition. P1 represents the position of a rear end of a region of a metallic shell ledge, the region being in contact with an insulator. P2 represents the position of a rear end of a region of the insulator ledge, the region being in contact with the center electrode. Front end surfaces of the metallic shell, the insulator, and center electrode, an imaginary plane S1 which is perpendicular to the axis and contains position P1, and an imaginary plane perpendicular to the axis and contains position P2 are disposed in this order from front side to rear side along the axis. The axial distance A from the front end surface of the insulator to imaginary plane S1 and axial distance B from the imaginary plane S1 to imaginary plane S2 satisfy $0.5 \times A \leq B$.

8 Claims, 4 Drawing Sheets

PLASMA JET IGNITION PLUG

FIELD OF INVENTION

The present invention relates to a plasma jet ignition plug.

BACKGROUND OF THE INVENTION

Conventionally, a spark plug has been used to ignite an air-fuel mixture through spark discharge (may be referred to merely as "discharge") for operation of an engine, such as an automotive internal combustion engine. In recent years, high output and low fuel consumption have been required of internal combustion engines. To fulfill such requirements, development of a plasma jet ignition plug has been conducted, since the plasma jet ignition plug provides quick propagation of combustion and exhibits such high ignition performance as to be capable of reliably igniting even a lean air-fuel mixture having a higher ignition-limit air-fuel ratio.

The plasma jet ignition plug has a structure in which an insulator formed from ceramic or the like surrounds a spark discharge gap between a center electrode and a ground electrode, thereby forming a small-volume discharge space called a cavity. An example system of ignition of the plasma jet ignition plug is described. For ignition of an air-fuel mixture, first, high voltage is applied between the center electrode and the ground electrode, thereby generating spark discharge. By virtue of associated occurrence of dielectric breakdown, current can be applied between the center electrode and the ground electrode with a relatively low voltage. Thus, through transition of a discharge state from the spark discharge effected by further supply of energy, plasma is generated within the cavity. The generated plasma is jetted out through an opening (so-called orifice), thereby igniting the air-fuel mixture (refer to, for example, Japanese Patent Application Laid-Open (kokai) No. 2006-294257, "Patent Document 1").

Meanwhile, an example of the geometric shape of plasma jetted out from the opening is the form of a pillar of fire (hereinafter, such a form of plasma is referred to as "flame-like"). Because of extension in the direction of jet, the flame-like plasma is characterized by a large contact area with an air-fuel mixture and by high ignition performance.

Problems to be Solved by the Invention

However, in order to jet out flame-like plasma, high-energy current must be supplied to the plasma jet ignition plug. Supply of high-energy current causes intensive erosion of the center and ground electrodes and a like problem, potentially resulting in deterioration in durability of the plasma jet ignition plug. Thus, it is desirable that high ignition performance can be ensured by means of flame-like plasma being jetted out through supply of minimal-energy current. A plasma jet ignition plug having high plasma generation efficiency allows reduction in supplied energy while ensuring high ignition performance. An example method of improving plasma generation efficiency is to increase temperature within the cavity at the time of ignition. A conceivable method of increasing temperature within the cavity is to increase the temperature of the center electrode and the insulator at the time of ignition. However, an increase in the temperature of the insulator may involve the occurrence of preignition, a phenomenon that ignition takes place in advance of regular ignition timing with the insulator serving as a heat source.

SUMMARY OF THE INVENTION

An object of the present invention is to provide a plasma jet ignition plug which exhibits high plasma generation efficiency while restraining the occurrence of preignition.

To achieve the above-mentioned object, the present invention provides a plasma jet ignition plug described below in (1).

(1) A plasma jet ignition plug comprises a center electrode; an insulator having an axial bore extending in a direction of an axis and holding the center electrode within the axial bore; a metallic shell holding the insulator; and a ground electrode joined to the metallic shell and disposed frontward of the insulator. The insulator has an insulator ledge in direct or indirect contact with the center electrode for holding the center electrode. The center electrode has a taper portion in direct or indirect contact with the insulator ledge; a trunk portion located rearward of the taper portion with respect to the direction of the axis; and a front portion located frontward of the taper portion with respect to the direction of the axis. The metallic shell has a metallic shell ledge in direct or indirect contact with the insulator for holding the insulator. P1 represents a position of a rear end with respect to the direction of the axis of a region of the metallic shell ledge, the region being in direct or indirect contact with the insulator. P2 represents a position of a rear end with respect to the direction of the axis of a region of the insulator ledge, the region being in direct or indirect contact with the center electrode. A front end surface of the metallic shell, a front end surface of the insulator, a front end surface of the center electrode, an imaginary plane S1 which is perpendicular to the direction of the axis and which contains the position P1, and an imaginary plane S2 which is perpendicular to the direction of the axis and which contains the position P2 are disposed in this order from a front side to a rear side along the direction of the axis. An axial distance A from the front end surface of the insulator to the imaginary plane S1 and an axial distance B from the imaginary plane S1 to the imaginary plane S2 satisfy a relational expression $0.5 \times A \leq B$.

In the plasma jet ignition plug described above in (1), preferably, (2) the axial distance A and the axial distance B satisfy a relation expression A B, (3) an axial distance C from the front end surface of the metallic shell to the imaginary plane S1 satisfies a relational expression $C \geq 3$ mm, (4) the ground electrode 6 has a contact portion, in contact with the front end surface of the insulator, formed at at least a portion of a facing surface of the ground electrode, the facing surface facing the front end surface of the insulator, and (5) the contact portion is formed continuously in such a manner as to encircle the axial bore.

Effects of the Invention

In the plasma jet ignition plug according to the present invention, the front end surface of the center electrode is disposed rearward of the front end surface of the insulator. Thus, cooling of the center electrode associated with introduction of new air-fuel mixture into a combustion chamber can be prevented. Also, since the front end surface of the insulator is disposed rearward of the front end surface of the metallic shell, the outer circumferential surface of a front end portion of the insulator is unlikely to receive heat from combustion gas. Thus, an increase in temperature of the insulator can be prevented. Also, since the metallic shell ledge is disposed frontward of the taper portion of the center electrode, a heat transfer path of the insulator becomes shorter than a heat transfer path of the center electrode. As a result, the temperature of a front end portion of the insulator is likely to decrease, whereas the temperature of the center electrode is unlikely to decrease.

Furthermore, since the plasma jet ignition plug according to the present invention satisfies the relational expression $0.5 \times A \leq B$, preferably the relational expression $A \leq B$, heat transfer from the front end portion of the insulator is promoted, whereas heat transfer from the front end portion of the center electrode is reduced. Thus, there can be provided a plasma jet ignition plug which exhibits high plasma generation efficiency while restraining the occurrence of preignition.

Also, by means of the axial distance C satisfying the relational expression $C \geq 3$ mm, the insulator can be prevented from receiving, from the metallic shell, heat which the metallic shell has received. Accordingly, the temperature of the front end portion of the insulator does not become excessively high, so that the occurrence of preignition can be restrained.

When the ground electrode has the contact portion, in contact with the front end surface of the insulator, formed at at least a portion of the facing surface of the ground electrode, the facing surface facing the front end surface of the insulator, heat of the front end portion of the insulator is released not only through the ledge of the metallic shell but also through the contact portion. Thus, the occurrence of preignition can be further restrained.

Furthermore, when the contact portion is formed continuously in such a manner as to encircle the axial bore, combustion gas does not enter a space between the insulator and the ground electrode. Thus, an increase in temperature of the insulator caused by combustion gas can be prevented, so that the occurrence of preignition can be further restrained.

DETAILED DESCRIPTION OF THE INVENTION

Figure 1:
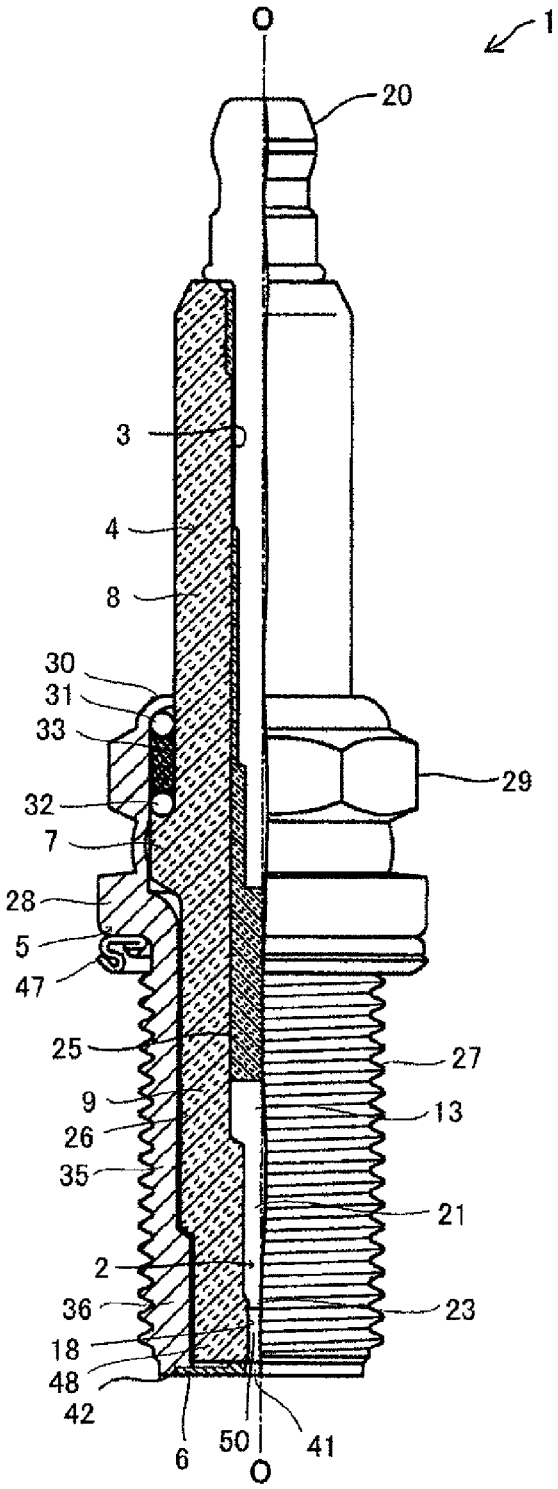
FIG. 1 is an explanatory, partially sectional view showing the configuration of a plasma jet ignition plug according to an embodiment of the present invention.
Figure 2:
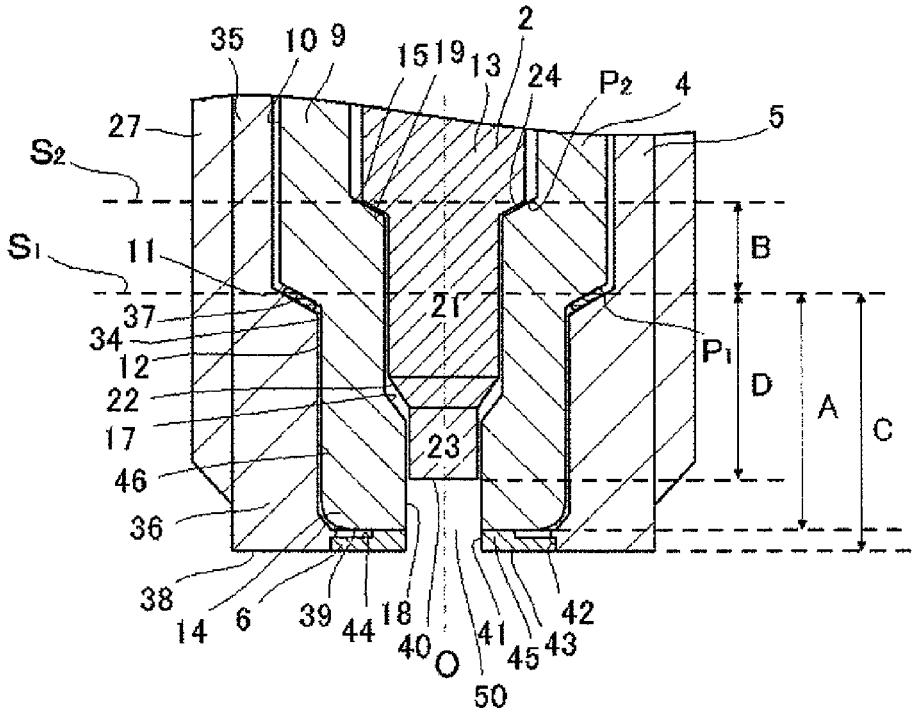
FIG. 2 is an explanatory sectional view showing essential portions of the plasma jet ignition plug of FIG. 1.

FIG. 1 shows a plasma jet ignition plug according to an embodiment of the present invention. FIG. 1 shows, partially in section, the configuration of a plasma jet ignition plug 1 according to the embodiment of the present invention. FIG. 2 shows, in section, essential portions of the plasma jet ignition plug 1. In the following description with reference to FIGS. 1 and 2, a downward direction on the paper on which FIG. 1 appears is referred to as a frontward direction along an axis O, and an upward direction on the paper is referred to as a rearward direction along the axis O.

As shown in FIGS. 1 and 2, the plasma jet ignition plug 1 includes a substantially tubular insulator 4 having an axial bore 3 extending in the direction of the axis O, a center electrode 2 accommodated within the axial bore 3 of the insulator 4 on a front side, a metal terminal 20 whose portion is accommodated within the axial bore 3 of the insulator 4 on a rear side, a metallic shell 5 holding the insulator 4, and a ground electrode 6 joined to the metallic shell 5 and disposed frontward of the insulator 4.

The insulator 4 is a substantially cylindrical insulation member formed from alumina or the like by firing and having the axial bore 3 along the direction of the axis O. The insulator 4 has a flange portion 7 having the largest outside diameter and formed substantially at its center with respect to the direction of the axis O. The insulator 4 has a rear trunk portion 8 extending rearward of the flange portion 7 and having an outside diameter smaller than that of the flange portion 7. The rear trunk portion 8 accommodates therein a portion of the metal terminal 20. The insulator 4 has a front trunk portion 9 extending frontward of the flange portion 7 and having an outside diameter smaller than that of the flange portion 7. The front trunk portion 9 accommodates therein a seal body 25 and a portion of the center electrode 2. Furthermore, the insulator 4 has an insulator front end portion 14 having an outside diameter smaller than that of the front trunk portion 9 and extending frontward of the front trunk portion 9 via an insulator taper portion 11 whose outside diameter reduces frontward from the front trunk portion 9. The insulator front end portion 14 accommodates therein the rest of the center electrode 2. The axial bore 3 of the insulator 4 extends frontward from the rear end of the insulator 4 as follows: the axial bore 3 extends through the rear trunk portion 8, the flange portion 7, and the front trunk portion 9 while having substantially the same inside diameter; the axial bore 3 extends through the front trunk portion 9 and reduces frontward in inside diameter so as to form an insulator ledge 15; and the axial bore 3 extends from the insulator ledge 15 through the insulator front end portion 14 while having a smaller inside diameter than in the front trunk portion 9. The insulator front end portion 14 has a second insulator ledge 17 located frontward of the insulator ledge 15 and formed with its inside diameter being further reduced frontward. The insulator front end portion 14 accommodates therein a forefront portion 23 of the center electrode 2 at a position located frontward of the second insulator ledge 17. The inner circumferential surface of the insulator front end portion 14, which accommodates therein the forefront portion 23, and a front end surface 40 of the forefront portion 23 define a discharge space called a cavity 50.

The center electrode 2 is a substantially circular columnar electrode rod formed of a metal having excellent thermal conductivity, such as Ni or an Ni alloy. The center electrode 2 may internally have a metal core (not shown) formed of a metal higher in thermal conductivity than Ni, such as Cu. Also, the center electrode 2 may have a disk-like electrode tip joined to its front end by welding or the like. The disk-like electrode tip is formed of an alloy which contains Ir, Pt, W, or Ni as a main component. Provision of the electrode tip is preferred because of enhancement of resistance to spark-induced erosion. Preferably, the electrode tip has a thickness of at least 0.3 mm along the direction of the axis O. Through employment of a thickness of at least 0.3 mm, sufficient durability can be attained, so that a gap between the two electrodes is unlikely to increase over a long period of use. Eventually, an increase in discharge voltage required for generation of sparks can be maintained at low level. Also, the thickness is sufficient for welding the electrode tip to the center electrode base metal. In the present embodiment, the "center electrode" encompasses the electrode tip formed integral with the center electrode 2.

The center electrode 2 includes a taper portion 19 in direct or indirect contact with the insulator ledge 15, a trunk portion 13 located rearward of the taper portion 19, and a front portion 21 located frontward of the taper portion 19. The front portion 21 is smaller in outside diameter than the trunk portion 13. In the present embodiment, the center electrode 2 further includes the forefront portion 23 located frontward of the front portion 21 with a second taper portion 22 therebetween and being smaller in outside diameter than the front portion 21.

In the present embodiment, the taper portion 19 of the center electrode 2 is in indirect contact with the insulator ledge 15 via a packing 24. The packing 24 is formed of a metal having high thermal conductivity, such as Cu or Fe. The taper portion 19 and the insulator ledge 15 may be in indirect contact with each other via plating on the insulator 4 or may be in direct contact with each other without another member intervening therebetween. The case where the taper portion 19 and the insulator ledge 15 are in indirect contact with each other excludes the case where air intervenes between the taper portion 19 and the insulator ledge 15.

The center electrode 2 is electrically connected to the metal terminal 20 via an electrically conductive seal body 25 provided within the axial bore 3 and formed of a mixture of metal and glass. The center electrode 2 and the metal terminal 20 are fixed within the axial bore 3 and electrically communicate with each other by means of the seal body 25. The metal terminal 20 is connected to a high-voltage cable via a plug cap, whereby high voltage from a power supply is applied thereto (not shown).

The metallic shell 5 is a substantially cylindrical metal member formed of an electrically conductive steel material; for example, low-carbon steel, and having a through hole 26 concentric with the axial bore 3. The metallic shell 5 is adapted to fix the plasma jet ignition plug 1 to the engine head of an internal combustion engine (not shown). The metallic shell 5 holds the insulator 4 in the through hole 26. The metallic shell 5 has a threaded portion 27 to be threadingly engaged with the engine head of the internal combustion engine. The metallic shell 5 has a seat portion 28 located rearward of the threaded portion 27 and formed on an outer circumferential surface thereof. A ring-shaped gasket 47 is fitted to the metallic shell 5 between the rear end of the threaded portion 27 and the seat portion 28. Furthermore, the metallic shell 5 has a tool engagement portion 29 provided rearward of the seat portion 28 and allowing a tool, such as a plug wrench, to be fitted thereto when the metallic shell 5 is to be mounted to the engine head. The metallic shell 5 has a crimp portion 30 provided rearward of the tool engagement portion 29 and adapted to retain the insulator 4. Two ring members 31 and 32 are provided in an intervening manner in a space formed between the rear trunk portion 8 of the insulator 4 and a portion of the metallic shell 5 ranging from the tool engagement portion 29 to the crimp portion 30. Furthermore, a space between the two ring members 31 and 32 is filled with talc 33.

In the through hole 26 of the metallic shell 5, the metallic shell 5 has a metallic shell ledge 34 which is located frontward of the seat portion 28 and in direct or indirect contact with the insulator 4 for holding the insulator 4. The metallic shell 5 has a metallic shell trunk portion 35 extending rearward of the metallic shell ledge 34, and a metallic shell front end portion 36 extending frontward of the metallic shell ledge 34. The metallic shell trunk portion 35 is larger in inside diameter than the metallic shell front end portion 36.

In the present embodiment, the metallic shell ledge 34 of the metallic shell 5 is in indirect contact with the insulator taper portion 11 via a packing 37. The packing 37 is formed of a metal having high thermal conductivity, such as Cu or Fe. The metallic shell ledge 34 and the insulator taper portion 11 may be in direct contact with each other via plating on the insulator 4 and/or the metallic shell 5 or may be in direct contact with each other without another member intervening therebetween. The case where the metallic shell ledge 34 and the insulator taper portion 11 are in direct contact with each other excludes the case where air intervenes between the metallic shell ledge 34 and the insulator taper portion 11.

By means of the insulator taper portion 11 being supported by the metallic shell ledge 34, the insulator 4 is united to the metallic shell 5. Gastightness between the metallic shell 5 and the insulator 4 is maintained by means of, for example, the packing 37, thereby preventing outflow of combustion gas.

The present invention proposes a plasma jet ignition plug having a structure that can reduce heat transfer from the center electrode 2 for enhancing plasma generation efficiency by means of increasing temperature within the cavity 50 at the time of ignition, as well as a structure that avoids an excessive increase in temperature of the insulator 4 for restraining the occurrence of preignition while increasing temperature within the cavity 50.

As shown in FIG. 2, the plasma jet ignition plug of the present invention is configured as follows: when P1 represents the position of the rear end of a region of the metallic shell ledge 34, the region being in direct or indirect contact with the insulator 4, and P2 represents the position of the rear end of a region of the insulator ledge 15, the region being in direct or indirect contact with the center electrode 2, a front end surface 38 of the metallic shell 5, a front end surface 39 of the insulator 4, the front end surface 40 of the center electrode 2, an imaginary plane S1 which is perpendicular to the direction of the axis O and which contains the position P1, and an imaginary plane S2 which is perpendicular to the direction of the axis O and which contains the position P2 are disposed in this order from the front side to the rear side along the direction of the axis O. Also, the imaginary plane S1 is located rearward of the front end of the threaded portion 27.

According to the plasma jet ignition plug of the present invention, since the front end surface 40 of the center electrode 2 is disposed rearward of the front end surface 39 of the insulator 4, the insulator 4 serves as a wall. Thus, even though a new air-fuel mixture is introduced into a combustion chamber, the center electrode 2 is unlikely to be affected by the air-fuel mixture of low temperature. Therefore, cooling of the center electrode 2 can be prevented. Also, according to the plasma jet ignition plug of the present invention, since the front end surface 39 of the insulator 4 is disposed rearward of the front end surface 38 of the metallic shell 5, a front end portion outer circumferential surface 12 of the insulator 4 is unlikely to receive heat from combustion gas. Therefore, an increase in temperature of the insulator 4 can be prevented.

Also, an outer circumferential surface of the center electrode 2 between the front end and the taper portion 19 of the center electrode 2 and an inner circumferential surface of the insulator 4 between the front end and the insulator ledge 15 of the insulator 4 are virtually not in contact with each other. That is, there is no path of conduction of heat of the center electrode 2 to the insulator 4 between the outer circumferential surface of the center electrode 2 ranging from the front end of the center electrode 2 to the taper portion 19 of the center electrode 2 and the inner circumferential surface of the insulator 4 ranging from the front end of the insulator 4 to the insulator ledge 15. Thus, since there is no path of heat conduction at the forefront portion 23 and the front portion 21 of the center electrode 2, heat is unlikely to be released therefrom. Therefore, the temperature of the center electrode 2 is likely to be maintained.

Heat of the forefront portion 23 and the front portion 21 of the center electrode 2 is conducted to the insulator 4 through a heat conduction path implemented by a region where the taper portion 19 of the center electrode 2 and the insulator ledge 15 are in contact with each other. Furthermore, heat of the insulator front end portion 14 is conducted to the metallic shell 5 through a heat conduction path implemented by a region where the insulator taper portion 11 and the metallic shell ledge 34 are in contact with each other. Also, heat of the metallic shell 5 is released to the ambient atmosphere through a heat conduction path implemented by a threaded hole portion of an internal combustion engine which is threadingly engaged with the threaded portion 27 of the metallic shell 5. Thus, the inventor of the present invention has conceived that the arrangement of the taper portion 19 of the center electrode 2, the insulator ledge 15, the insulator taper portion 11, and the metallic shell ledge 34, which form heat conduction paths, has a particularly large effect on heat transfer from the center electrode 2 and from the insulator 4.

According to the plasma jet ignition plug of the present invention, the taper portion 19 of the center electrode 2 is disposed rearward of the metallic shell ledge 34. Heat of the insulator front end portion 14 is conducted to the threaded portion 27 via the metallic shell ledge 34. Meanwhile, heat of the forefront portion 23 and the front portion 21 of the center electrode 2 is conducted to the threaded portion 27 via the taper portion 19 disposed rearward of the metallic shell ledge 34 and further via the metallic shell ledge 34. Thus, the heat transfer path of the insulator 4 becomes shorter than the heat transfer path of the center electrode 2. As a result, heat transfer from the insulator front end portion 14 is accelerated, so that the temperature of the insulator 4 is likely to decrease. By contrast, heat transfer from the center electrode 2 is reduced, so that the temperature of the center electrode 2 is unlikely to decrease.

According to the plasma jet ignition plug of the present invention, an axial distance A from the front end surface 39 of the insulator 4 to the imaginary plane S1 and an axial distance B from the imaginary plane S1 to the imaginary plane S2 satisfy the relational expression $0.5 \times A \leq B$, preferably $A \leq B$. When A and B satisfy the relational expression $0.5 \times A \leq B$, the heat transfer path of the insulator 4 becomes short, and the heat transfer path of the center electrode 2 becomes relatively long. Thus, heat transfer from the front end portion of the insulator 4 is accelerated, whereas heat transfer from the forefront portion 23 and the front portion 21 of the center electrode 2 is reduced. Therefore, there can be provided a plasma jet ignition plug which exhibits high plasma generation efficiency while restraining the occurrence of preignition.

According to the plasma jet ignition plug of the present invention, an axial distance C from the front end surface 38 of the metallic shell 5 to the imaginary plane S1 satisfies the relational expression $C \geq 3$ mm. When the axial distance C satisfies the relational expression $C \geq 3$ mm, the insulator 4 can be prevented from receiving, from the metallic shell 5, heat which the metallic shell 5 has received. Accordingly, the temperature of the insulator front end portion 14 does not become excessively high, so that the occurrence of preignition can be restrained.

The ground electrode 6 may be formed of a publicly known metal having excellent resistance to spark-induced erosion. Preferably, the ground electrode 6 is formed of, for example, an alloy which contains W, Ir, Pt, or Ni as a main component. When the ground electrode 6 is formed of the alloy, the ground electrode 6 exhibits excellent resistance to spark-induced erosion. In the case where the ground electrode 6 assumes the form of a disk and has an opening 41 at the center thereof, an increase in the diameter of the opening 41 can be restrained. Thus, a gap between the two electrodes is unlikely to increase, so that an increase in discharge voltage can be restrained as in the case of the center electrode 2. The ground electrode 6 has, for example, a disk-like shape having a thickness of 0.3 mm to 1 mm and has, at its center, the opening 41 for allowing the cavity 50 to communicate with the ambient atmosphere. In the present embodiment, the ground electrode 6 is integrally joined to the metallic shell 5 in the following manner: while the ground electrode 6 is engaged with an engagement portion 42 formed on an inner circumferential surface of the metallic shell front end portion 36 of the metallic shell 5 with a front end surface 43 of the ground electrode 6 and the front end surface 38 of the metallic shell 5 being flush with each other, the outer circumferential edge of the ground electrode 6 is, for example, full-circle laser-welded to the engagement portion 42. In the present embodiment, the inner circumferential surface of the opening 41 of the ground electrode 6 and a forefront portion inner circumferential surface 18 of the insulator 4 have the same diameter and are concentric with each other. However, the inside diameter of the opening 41 of the ground electrode 6 may be greater than that of the forefront portion inner circumferential surface 18.

Figure 3A:
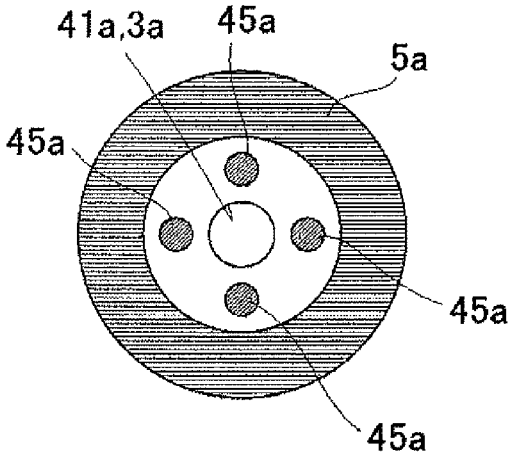
FIG. 3A is an explanatory sectional view of a plasma jet ignition plug as cut by a plane which cross-sections contact portions and is orthogonal to the axial direction.
Figure 3B:
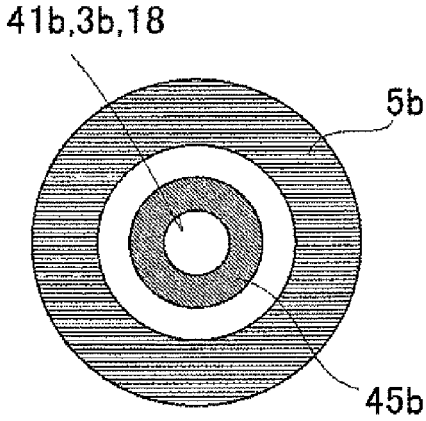
FIG. 3B is an explanatory sectional view of a plasma jet ignition plug as cut by a plane which cross-sections a contact portion and is orthogonal to the axial direction.

Also, in the present embodiment, the ground electrode 6 has a contact portion 45, in contact with the front end surface 39 of the insulator 4, formed at a portion of a facing surface 44 of the ground electrode 6, the facing surface 44 facing the front end surface 39 of the insulator 4. FIGS. 3A and 3B are explanatory sectional views of plasma jet ignition plugs as cut by a plane which cross-sections the contact portion and is orthogonal to the axial direction, showing example shapes of contact portions 45*a* and 45*b*. As shown in FIG. 3A, the ground electrode may be a disk-like ground electrode which has an opening 41*a* and circular columnar contact portions 45*a* disposed at circumferentially equal intervals around the opening 41*a*; i.e., around an axial bore 3*a*. Also, as shown in FIG. 3B, the ground electrode may be a disk-like ground electrode which has an opening 41*b* and an annular contact portion 45*b* formed continuously in such a manner as to encircle the opening 41*b*; i.e., an axial bore 3*b*. The annular contact portion 45*b* may be disposed such that its inner circumferential surface is flush with the insulator forefront portion inner circumferential surface 18. In this case, the contact portion 45*b* may have such a size that the contact portion 45*b* is in contact with a portion of the front end surface of an insulator 4*b* or in contact with the entire front end surface of the insulator 4*b*. Also, the annular contact portion may have an inside diameter larger than that of an insulator forefront portion; i.e., the inner circumferential surface of the annular contact portion may be disposed closer to the metallic shell than is the inner circumferential surface of the insulator forefront portion which partially defines the cavity (not shown).

When the ground electrode 6 has the contact portion 45, heat of the insulator front end portion 14 is released not only through the metallic shell ledge 34 but also through the contact portion 45. Thus, the occurrence of preignition can be further restrained. Furthermore, when the contact portion 45 is formed continuously in such a manner as to encircle the axial bore 3, combustion gas does not enter a space between the insulator 4 and the ground electrode 6. Thus, an increase in temperature of the insulator 4 which could otherwise be caused by combustion gas can be prevented, so that the occurrence of preignition can be further restrained.

The plasma jet ignition plug 1 having the above-mentioned structure generates plasma and ignites an air-fuel mixture, for example, in the following manner. In igniting the air-fuel mixture, first, high voltage is applied between the center electrode 2 and the ground electrode 6 to generate spark discharge. By virtue of associated occurrence of dielectric breakdown, current can be applied between the center electrode 2 and the ground electrode 6 with relatively low voltage. Further, current having a high energy of 30 mJ to 200 mJ is applied between the center electrode 2 and the ground electrode 6 from a power source having an arbitrary output for transition of a discharge state from spark discharge, thereby generating plasma within the cavity 50. The thus-generated plasma is discharged in a flame form from the opening 41 of the ground electrode 6, thereby igniting the air-fuel mixture.

The plasma jet ignition plug 1 having the above-described structure can exhibit improved resistance to preignition by means of avoiding an excessive increase in the temperature of the insulator 4 and can maintain temperature within the cavity 50 by means of reducing heat transfer from the center electrode 2. Thus, there can be provided a plasma jet ignition plug which exhibits high plasma generation efficiency while restraining the occurrence of preignition.

The above-mentioned plasma jet ignition plug 1 is manufactured by a publicly known method. First, a well-known electrode material, such as an Ni-based alloy, is machined for yielding the center electrode 2 having the taper portion 19 at a predetermined position. At this time, as mentioned above, a disk-like electrode tip formed of material having excellent erosion resistance may be laser-welded to the front end surface of the center electrode 2. In a separate step, a well-known electrode material is machined into the ground electrode 6 having, for example, an annular form. Preferably, the contact portion 45 is formed on one side of the annular ground electrode 6, so that, when the side of the ground electrode 6 is placed to face the front end surface 39 of the insulator 4, the contact portion 45 comes into contact with the front end surface 39.

Next, material for ceramic, or the like is formed into a predetermined shape, followed by firing for yielding the insulator 4 having the insulator ledge 15 and the insulator taper portion 11 at respectively predetermined positions. The center electrode 2 is assembled to the insulator 4 by a publicly known method so as to bring the taper portion 19 into contact with the insulator ledge 15.

The outer circumferential surface of a tubular body formed of low-carbon steel or the like is subjected to machining, thereby forming the seat portion 28, the tool engagement portion 29, the threaded portion 27, etc., and also, the metallic shell ledge 34 is formed on the inner circumferential surface of the tubular body at a predetermined position, thereby yielding the metallic shell 5. Next, the ground electrode 6 yielded above is joined to the engagement portion 42 formed on a front end portion inner circumferential surface 46 of the metallic shell 5 by, for example, laser welding or electric resistance welding.

The insulator 4 to which the center electrode 2 is assembled is assembled to the metallic shell 5 to which the ground electrode 6 is joined, and the crimp portion 30 is crimped. By this procedure, the insulator 4 is pressed frontward within the metallic shell 5, whereby the insulator taper portion 11 is supported by the metallic shell ledge 34. Thus, the metallic shell 5 and the insulator 4 are united together. In this manner, the plasma jet ignition plug 1 is manufactured.

The plasma jet ignition plug according to the present invention is used as an igniter for an automotive internal combustion engine; for example, a gasoline engine. The plasma jet ignition plug is fixed at a predetermined position such that the threaded portion 27 is threadingly engaged with a threaded hole provided in a head (not shown) which dividingly forms combustion chambers of an internal combustion engine. The plasma jet ignition plug according to the present invention can be used in any type of internal combustion engine, but can be particularly preferably used in an internal combustion engine having high air-fuel ratio, since the plasma jet ignition plug can exhibit high ignition performance through supply of minimal energy while restraining the occurrence of preignition.

The plasma jet ignition plug 1 according to the present invention is not limited to the embodiment described above, but may be modified in various other forms, so long as the object of the present invention can be achieved.

EXAMPLES

Evaluation of Plasma Generation Efficiency

A plasma generation efficiency evaluation test was conducted on plasma jet ignition plugs which differed in the axial distance A, the axial distance B, and the inside diameter of a front end portion of the axial bore of the insulator (cavity diameter).

For use in the evaluation test as test samples, the plasma jet ignition plugs similar to the plasma jet ignition plug shown in FIG. 1 were manufactured under the following conditions: the difference (A−D) between the axial distance A and the axial distance D is 1 mm; the disk-like ground electrode having a thickness (C−A) of 0.5 mm and having, at its center, an opening of the same diameter as the cavity diameter is joined to the inner circumferential surface of a front end portion of the metallic shell; and the facing surface of the ground electrode which faces the front end surface of the insulator is in contact with the front end surface of the insulator continuously around the axial bore.

The manufactured plasma jet ignition plugs were mounted to the chamber which was filled with standard gas at a pressure of 0.4 MPa. Energy of 50 mJ was supplied to the plasma jet ignition plugs for generating discharge.

Figure 4:
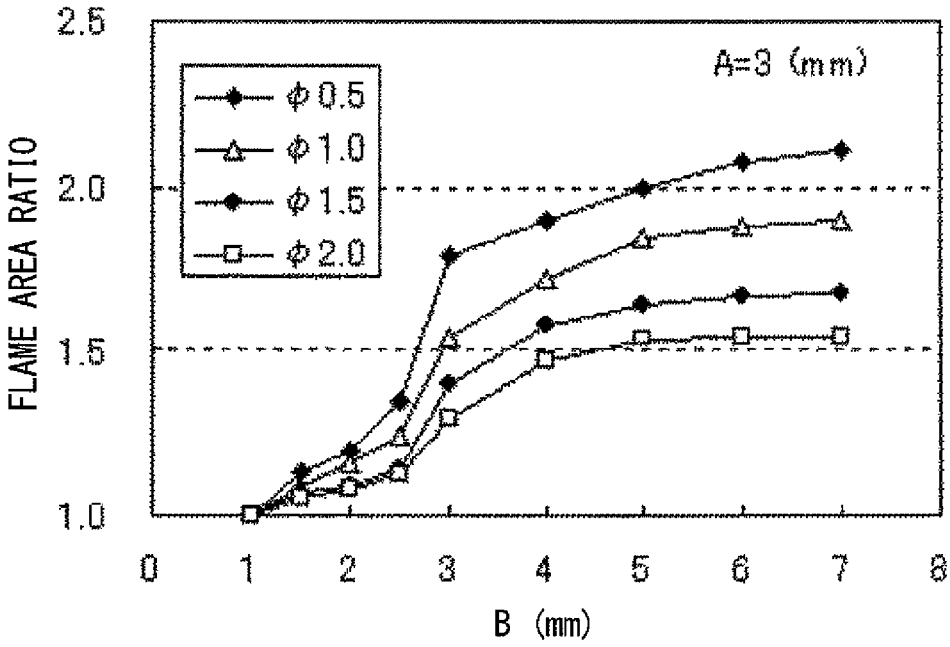
FIG. 4 is a graph showing the results of an evaluation test on plasma jet ignition plugs having an axial distance A of 3 mm.
Figure 5:
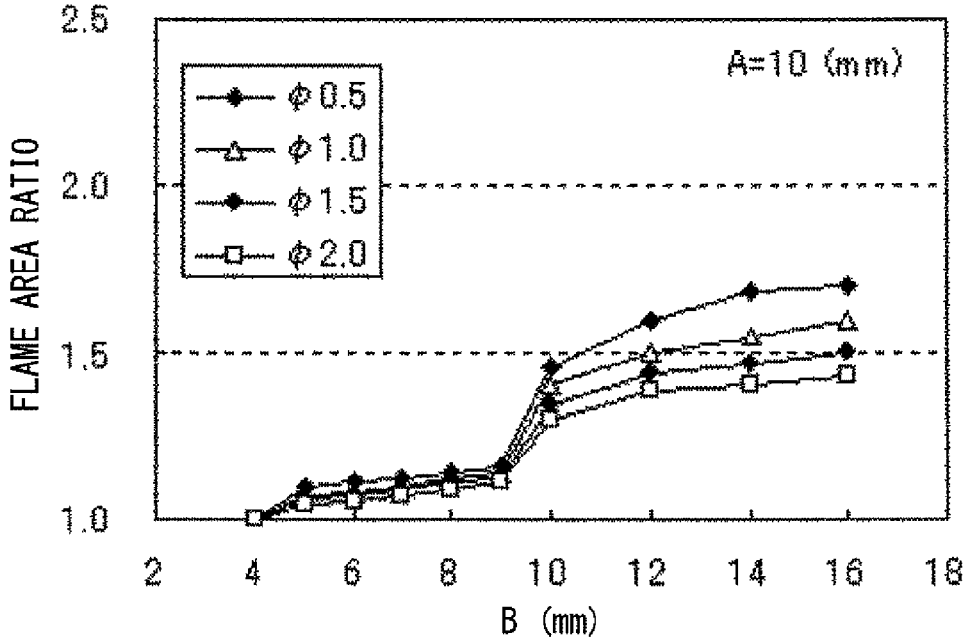
FIG. 5 is a graph showing the results of an evaluation test on plasma jet ignition plugs having an axial distance A of 10 mm.

The plasma jet ignition plugs which generated discharge were evaluated for plasma generation efficiency by means of measuring the flame area of discharged plasma by use of the schlieren visualization method. A schlieren image was captured 100 μs after trigger ignition. The captured image was binarized. The area of a black zone in the binarized image was measured as the area of a high-density portion of plasma flame. FIGS. 4 and 5 show the results of measurement.

FIG. 4 shows the results of the evaluation test on the plasma jet ignition plugs having an axial distance A of 3 mm. The horizontal axis indicates the axial distance B. The vertical axis indicates the ratio of the flame area measured with the axial distance B being varied in a range of 1 mm to 7 mm to the flame area measured with an axial distance B of 1 mm. Also, while the cavity diameter was varied at 0.5 mm intervals from 0.5 mm to 2.0 mm, the flame area was measured at individual cavity diameters, and the flame area ratio was calculated.

In the case of an axial distance A of 3 mm, the flame area ratio increased when B≥1.5 mm, and further increased when B≥3 mm. This indicates that, when A and B satisfy the relational expression 0.5×A≤B, particularly A≤B, the plasma generation efficiency improves. Also, the smaller the cavity diameter, the greater the flame area; i.e., the higher the effect of improving the plasma generation efficiency.

FIG. 5 shows the results of the evaluation test on the plasma jet ignition plugs having an axial distance A of 10 mm. Similar to the evaluation test on the plasma jet ignition plugs having an axial distance A of 3 mm shown in FIG. 4, the ratio of the flame area measured with the axial distance B being varied in a range of 4 mm to 16 mm to the flame area measured with an axial distance B of 4 mm was calculated.

In the case of an axial distance A of 10 mm, the flame area ratio increased when B≥5 mm, and further increased when B≥10 mm. This indicates that, when A and B satisfy the relational expression 0.5×A≤B, particularly A≤B, the plasma generation efficiency improves. Also, the smaller the cavity diameter, the greater the flame area; i.e., the higher the plasma generation efficiency.

Evaluation of Resistance to Preignition (1) A resistance to preignition evaluation test was conducted on plasma jet ignition plugs which differed in the axial distance A and the axial distance B.

For use in the evaluation test as test samples, the plasma jet ignition plugs similar to the plasma jet ignition plug shown in FIG. 1 were manufactured under the following conditions: the cavity diameter is 1.0 mm; the difference (A−D) between the axial distance A and the axial distance D is 1.0 mm; the disk-like ground electrode having a thickness (C−A) of 0.5 mm and having, at its center, an opening of the same diameter as the cavity diameter is joined to the inner circumferential surface of a front end portion of the metallic shell; and the facing surface of the ground electrode which faces the front end surface of the insulator is in contact with the front end surface of the insulator continuously around the axial bore.

The manufactured plasma jet ignition plugs were mounted to a single-cylinder 125 cc engine. The engine was operated at an engine speed of 9,000 rpm with full throttle opening until preignition occurred. During the operation, measurement was made for one minute under evaluation conditions (as indicated by the vertical axis of FIG. 6, at intervals of a crank angle of 0.5°).

Figure 6:
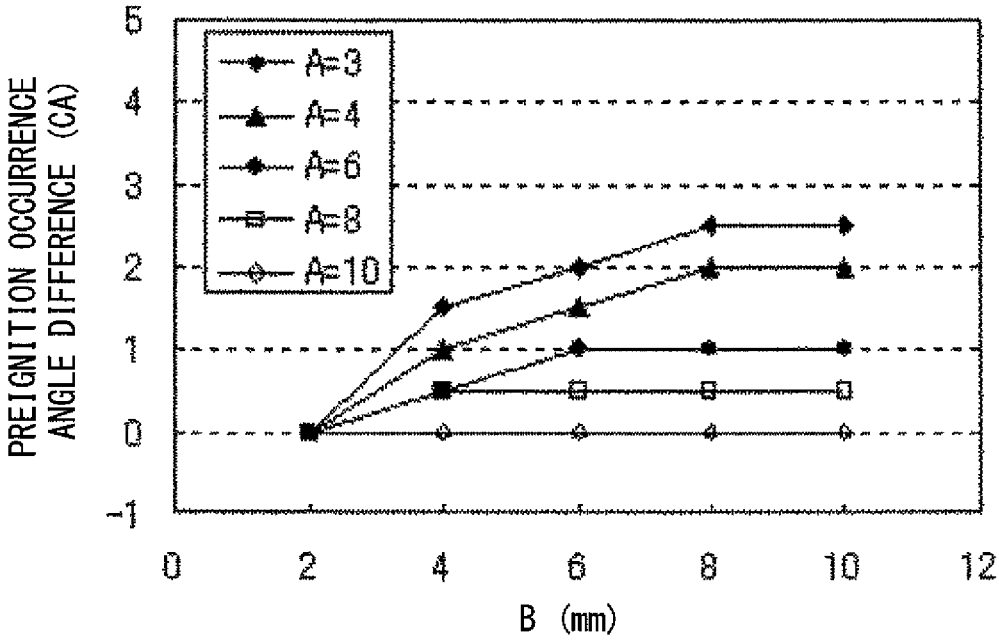
FIG. 6 is a graph showing the results of a resistance to preignition evaluation test.

In order to evaluate resistance to preignition of the manufactured plasma jet ignition plugs, a crank angle at which preignition occurred was measured as ignition timing at which preignition occurred once or more in one minute. FIG. 6 shows the results of measurement.

In FIG. 6, the horizontal axis indicates B, and the vertical axis indicates a preignition occurrence crank angle difference when B was varied at 2 mm intervals from 2 mm to 10 mm, and a preignition occurrence crank angle at a B value of 2 mm was used as a reference angle. Also, A was varied in a range of 3 mm to 10 mm, and associated preignition occurrence crank angles were measured, whereby corresponding preignition occurrence crank angle differences were calculated. A negative value is on the lag side, indicating deterioration in resistance to preignition. A positive value is on the lead side, indicating improvement in resistance to preignition.

As shown in FIG. 6, the greater the value of B, the greater the preignition angle difference, indicating improvement in resistance to preignition. Also, the smaller the value of A, the higher the effect of improving resistance to preignition. When A is 10 mm, even though the value of B increases, the effect of improving resistance to preignition is not observed, and deterioration in resistance to preignition is not observed, either.

When the value of A is small, the axial length of a front end portion of the center electrode is small. Thus, the smaller the value of B, the greater the amount of heat conducted from the center electrode to the insulator. Accordingly, heat transfer from the insulator is greatly affected. Therefore, conceivably, when the value of A was small, the greater the value of B, the more the resistance to preignition improved. Meanwhile, when the value of A is large, the axial length of the front end portion of the center electrode is large. Thus, the amount of heat conducted from the center electrode to the insulator is small irrespective of the value of B. Accordingly, heat transfer from the insulator becomes less affected. Therefore, conceivably, the greater the value of A, the more the influence of the value of B on resistance to preignition reduced.

(2) The resistance to preignition evaluation test was conducted on plasma jet ignition plugs which differed in the axial distance C from the front end surface of the metallic shell to the imaginary plane S1, in a manner similar to that of the evaluation test described above in (1).

Figure 7:
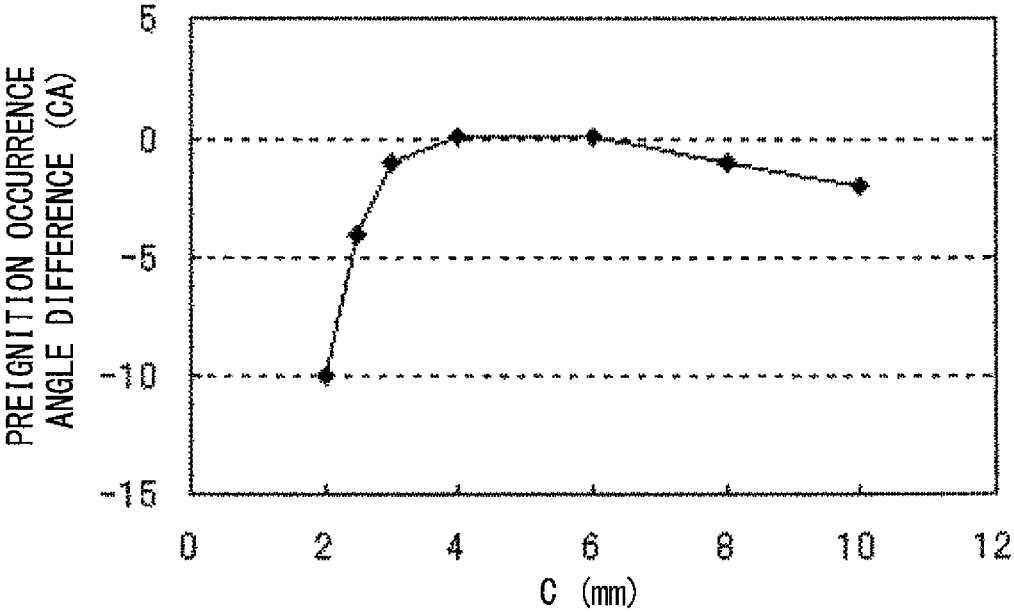
FIG. 7 is a graph showing the results of the resistance to preignition evaluation test.

In FIG. 7, the horizontal axis indicates C, and the vertical axis indicates a preignition occurrence crank angle difference when C was varied at 2 mm intervals from 2 mm to 10 mm, and a preignition occurrence crank angle at a C value of 4 mm was used as a reference angle.

As shown in FIG. 7, when the value of C reduces to less than 3 mm, the preignition occurrence crank angle difference sharply reduces, indicating deterioration in resistance to preignition.

DESCRIPTION OF REFERENCE NUMERALS

1: plasma jet ignition plug
2: center electrode
3: axial bore
4: insulator
5: metallic shell
6: ground electrode
7: flange portion
8: rear trunk portion
9: front portion
10: insulator trunk portion outer circumferential surface
11: insulator taper portion
12: front end portion outer circumferential surface of insulator
13: trunk portion
14: insulator front end portion
15: insulator ledge
17: second insulator ledge
18: forefront portion inner circumferential surface of insulator
19: taper portion
20: metal terminal
21: front end portion
22: second taper portion
23: forefront portion
24, 37: packing
25: seal body
26: through hole
27: threaded portion
28: seat portion
29: tool engagement portion
30: crimp portion
31, 32: ring member
33: talc
34: metallic shell ledge
35: metallic shell trunk portion
36: metallic shell front end portion
38: front end surface of metallic shell
39: front end surface of insulator
40: front end surface of center electrode

41: opening
42: engagement portion
43: front end surface of ground electrode
44: facing surface
45: contact portion
46: front end portion inner circumferential surface of metallic shell
47: gasket
50: cavity Having described the invention, the following is claimed:

1. A plasma jet ignition plug comprising:

a center electrode;

an insulator having an axial bore extending in a direction of an axis and holding the center electrode within the axial bore;

a metallic shell holding the insulator; and a ground electrode joined to the metallic shell and disposed frontward of the insulator;

wherein the insulator has an insulator ledge in direct or indirect contact with the center electrode for holding the center electrode;

the center electrode has a taper portion in direct or indirect contact with the insulator ledge, a trunk portion located rearward of the taper portion with respect to the direction of the axis, and a front portion located frontward of the taper portion with respect to the direction of the axis, wherein there is no contact between the front portion of the center electrode and the insulator;

the metallic shell has a metallic shell ledge in direct or indirect contact with the insulator for holding the insulator;

a front end surface of the metallic shell, a front end surface of the insulator, a front end surface of the center electrode, an imaginary plane S1 which is perpendicular to the direction of the axis and which contains a position P1, and an imaginary plane S2 which is perpendicular to the direction of the axis and which contains a position P2 are disposed in this order from a front side to a rear side along the direction of the axis, where the position P1 represents a position of a rear end with respect to the direction of the axis of a region of the metallic shell ledge, the region being in direct or indirect contact with the insulator, where the position P2 represents a position of a rear end with respect to the direction of the axis of a region of the insulator ledge, the region being in direct or indirect contact with the center electrode; and an axial distance A from the front end surface of the insulator to the imaginary plane S1 and an axial distance B from the imaginary plane S1 to the imaginary plane S2 satisfy a relational expression $0.5 \times A \leq B$.

2. A plasma jet ignition plug according to claim 1, wherein the axial distance A and the axial distance B satisfy a relation expression $A \leq B$.

3. A plasma jet ignition plug according to claim 2, wherein the front end surface of the metallic shell and the imaginary plane S1 are located an axial distance C away from each other, and the axial distance C satisfies a relational expression $C \geq 3$ mm.

4. A plasma jet ignition plug according to claim 1, wherein the front end surface of the metallic shell and the imaginary plane S1 are located an axial distance C away from each other, and the axial distance C satisfies a relational expression $C \geq 3$ mm.

5. A plasma jet ignition plug according to claim 4, wherein the ground electrode has a contact portion, in contact with the front end surface of the insulator, formed at at least a portion of a facing surface of the ground electrode, the facing surface facing the front end surface of the insulator.

6. A plasma jet ignition plug according to claim 5, wherein the contact portion is formed continuously in such a manner as to encircle the axial bore.

7. A plasma jet ignition plug according to claim 1, wherein the ground electrode has a contact portion, in contact with the front end surface of the insulator, formed at at least a portion of a facing surface of the ground electrode, the facing surface facing the front end surface of the insulator.

8. A plasma jet ignition plug according to claim 7, wherein the contact portion is formed continuously in such a manner as to encircle the axial bore.

* * * * *